US011355882B2

(12) United States Patent
Matsuno

(10) Patent No.: US 11,355,882 B2
(45) Date of Patent: Jun. 7, 2022

(54) BOARD-TO-BOARD CONNECTOR

(71) Applicant: Molex, LLC, Lisle, IL (US)

(72) Inventor: Genki Matsuno, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/988,744

(22) Filed: Aug. 10, 2020

(65) Prior Publication Data

US 2021/0194169 A1 Jun. 24, 2021

Related U.S. Application Data

(63) Continuation of application No. 15/800,914, filed on Nov. 1, 2017, now Pat. No. 10,741,956.

(30) Foreign Application Priority Data

Nov. 18, 2016 (JP) ..... 2016-224857

(51) Int. Cl.
*H01R 13/41* (2006.01)
*H01R 13/115* (2006.01)
(Continued)

(52) U.S. Cl.
CPC ..... *H01R 13/41* (2013.01); *H01R 12/73* (2013.01); *H01R 13/115* (2013.01); *H01R 13/22* (2013.01);
(Continued)

(58) Field of Classification Search
CPC ..... H01R 13/22; H01R 13/41; H01R 13/64; H01R 13/115; H01R 13/504; H01R 12/716
See application file for complete search history.

(56) References Cited

U.S. PATENT DOCUMENTS 3,732,531 A 5/1973 Bouley
5,030,107 A 7/1991 Moon
(Continued)

FOREIGN PATENT DOCUMENTS

JP 2004-247121 A 9/2004
JP 2006-185851 A 7/2006
(Continued)

OTHER PUBLICATIONS

Non-Final rejection received for U.S. Appl. No. 15/800,914, dated Jun. 21, 2018, 11 pages.
(Continued)

*Primary Examiner* — Oscar C Jimenez

(57) ABSTRACT

A plug connector is provided which is configured to be mated with a receptacle connector. The plug connector has a housing, a terminal and a reinforcing metal member. The housing has an elongated protrusion and a protrusion end part. The protrusion extends in a longitudinal direction from the end part. The protrusion has an upper side and the end part has upper and end faces. The terminal is at least partially embedded in the protrusion. The metal member is configured to be connected to the end part. The metal member has a main body portion and an end plate portion. The main body portion covers at least a portion of the upper face of the end part. The main body portion has an embedded plate portion which is embedded in the end part. The end plate portion covers at least a portion of the end face of the end part.

25 Claims, 11 Drawing Sheets

(51) Int. Cl.

| | |
|---|---|
| ***H01R 13/22*** | (2006.01) |
| ***H01R 13/64*** | (2006.01) |
| ***H01R 13/504*** | (2006.01) |
| ***H01R 13/24*** | (2006.01) |
| ***H01R 13/405*** | (2006.01) |
| ***H01R 12/73*** | (2011.01) |
| ***H01R 12/71*** | (2011.01) |

(52) U.S. Cl.
CPC ..... *H01R 13/2464* (2013.01); *H01R 13/405* (2013.01); *H01R 13/504* (2013.01); *H01R 13/64* (2013.01); *H01R 12/716* (2013.01)

(56) References Cited

U.S. PATENT DOCUMENTS

| | | | | |
|---|---|---|---|---|
| 5,501,009 | A | 3/1996 | McClure | |
| 6,250,935 | B1 | 6/2001 | Mochizuki et al. | |
| 6,902,411 | B2 | 6/2005 | Kubo | |
| 7,553,168 | B2 | 6/2009 | Zhu et al. | |
| 9,077,102 | B2 | 7/2015 | Miyazaki | |
| 9,196,984 | B2 * | 11/2015 | Ishida | H01R 12/716 |
| 9,413,089 | B2 | 8/2016 | Miyazaki | |
| 9,705,223 | B2 | 7/2017 | Miyazaki | |
| 9,899,771 | B2 * | 2/2018 | Ashibu | H01R 12/716 |
| 10,741,956 | B2 | 8/2020 | Matsuno | |
| 2004/0253848 | A1 | 12/2004 | Huang et al. | |
| 2005/0032400 | A1 | 2/2005 | Zhang et al. | |
| 2008/0207010 | A1 | 8/2008 | Ono | |
| 2008/0305657 | A1 | 12/2008 | Midorikawa | |
| 2010/0330821 | A1 | 12/2010 | Takeuchi et al. | |
| 2014/0377999 | A1 | 12/2014 | Miyazaki | |
| 2015/0263464 | A1 | 9/2015 | Arichika et al. | |
| 2016/0226184 | A1 * | 8/2016 | Katano | H01R 12/7005 |
| 2016/0268715 | A1 | 9/2016 | Kodaira | |
| 2016/0294082 | A1 | 10/2016 | Matsuno | |
| 2020/0381857 | A1 * | 12/2020 | Meng | H01R 13/631 |

FOREIGN PATENT DOCUMENTS

| | | | |
|---|---|---|---|
| JP | 2012-178248 | A | 9/2012 |
| JP | 2012-243598 | A | 12/2012 |
| JP | 2014-056762 | A | 3/2014 |
| JP | 2014212049 | A | 11/2014 |
| JP | 2015-122189 | A | 7/2015 |
| JP | 2016096079 | A | 5/2016 |
| JP | 2016162605 | A | 9/2016 |
| JP | 2016195057 | A | 11/2016 |
| JP | 2018067377 | A | 4/2018 |

OTHER PUBLICATIONS

Final rejection received for U.S. Appl. No. 15/800,914, dated Nov. 20, 2018, 13 pages.

Non-Final rejection received for U.S. Appl. No. 15/800,914, dated May 9, 2019, 15 pages.

Notification of reasons for refusal received for JP application No. 2016-224857, dated Jul. 14, 2020, 12 pages (6 pages of english translation and 6 pages of official copy).

Office action received for JP patent application No. 2020-171649, dated Oct. 5, 2021, 12 pages (6 pages of English translation and 6 pages of Official copy).

Notice of Allowance received for JP Application No. 2020-171649, dated Feb. 8, 2022, 05 Pages ( 02 Pages of English Translation and 03 Pages of Official notification).

* cited by examiner

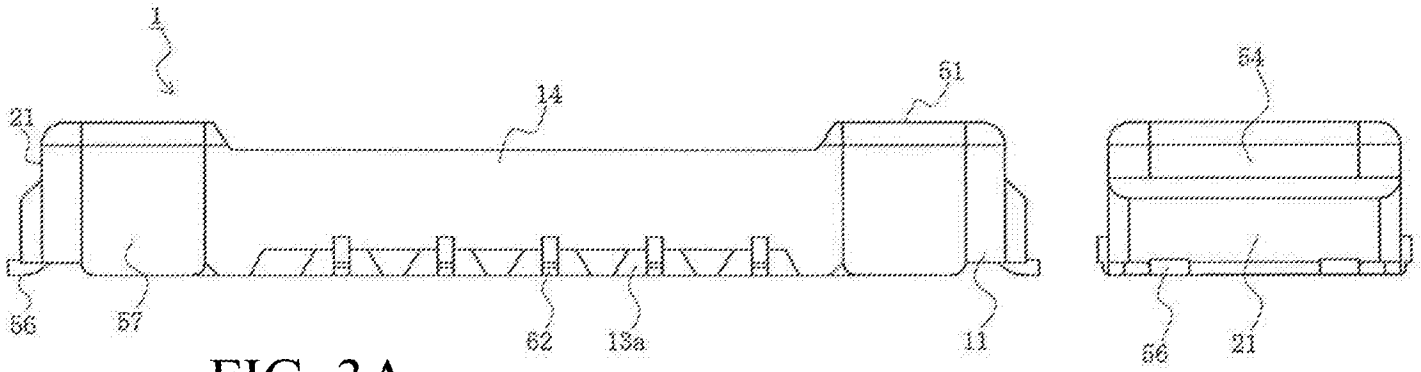
FIG. 3A
FIG. 3B
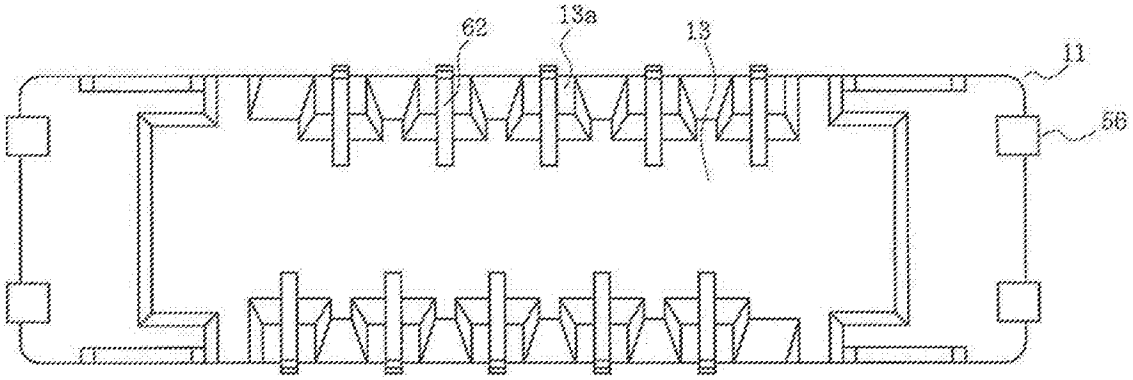
FIG. 3C

BOARD-TO-BOARD CONNECTOR

RELATED APPLICATIONS

This application is a continuation of U.S. patent application Ser. No. 15/800,914, filed Nov. 1, 2017, which claims priority to Japanese Application No. 2016-224857, filed Nov. 18, 2016, each of which are incorporated herein by reference in their entireties.

TECHNICAL FIELD

The present disclosure relates to a connector.

BACKGROUND ART

Conventionally, connectors such as board to board connectors, etc., have been used to electrically connect pairs of parallel circuit boards together. Such connectors are attached to each mutually facing surface on pairs of circuit boards and are mated together so as to be connected (see, for example, Patent Document 1).

FIG. 11 is a perspective view illustrating a conventional connector.

In the figure, 801 is a receptacle connector attached to a first circuit board not illustrated, while 901 is a plug connector attached to a second circuit board not illustrated. Additionally, receptacle connector 801 includes multiple receptacle terminals 861 installed in receptacle housing 811 made of an insulating material, while plug connector 901 includes multiple plug terminals 961 installed in plug housing 911 made of an insulating material.

Moreover, recess 812 is formed in receptacle housing 811 for housing plug housing 911. Additionally, when receptacle connector 801 mates with plug connector 901, the first circuit board and the second circuit board are electrically connected by mutually engaging corresponding receptacle terminal 861 and plug terminal 961. Note that receptacle terminal 861 includes a U shape, plug terminal 961 is housed inside a U-shaped trough, and plug terminal 961 is held from both sides by U-shaped side walls on both sides.

Patent Document 1: JP 2014-056762 A

SUMMARY

Unfortunately, in conventional connectors, while portions of receptacle terminal 861 corresponding to one of the U-shaped side walls is embedded in one of the side walls of recess 812 of receptacle housing 811, other portions of the U-shaped trough are separate from receptacle housing 811 so as to be free. Consequently, because the interval of the U-shaped side walls on both sides may flexibly change, the contact force to plug terminal 961 is weak, facilitating the extraction of plug terminal 961 from receptacle terminal 861. That is, the mating between receptacle connector 801 and plug connector 901 will be unnecessarily released.

Here, in order to resolve the conventional problem, an object is to provide a connector, wherein the contact force of a pair of contact protrusions contained in a first terminal to a second terminal is strong, the extraction force for extracting the second terminal from the first terminal is also strong, the conduction state between the first terminal and the second terminal can be assuredly maintained, and the mating state between a first connector and a second connector can be stably maintained.

Therefore, in a connector, the connector includes: a first connector having a first terminal, along with a first housing with the first terminal installed therein; and a second connector mating with the first connector and having a second terminal in contact with the first terminal, along with a second housing with the second terminal installed therein, wherein the first housing is a grooved recess that stretches in the longitudinal direction, with a protrusion of the second housing inserted into the recess, the first terminal includes a mating terminal housing part mating with the second terminal, with at least a portion of the first terminal embedded in the first housing and integrated with the first housing, and the mating terminal housing part includes a pair of contact protrusions protruding towards the center in the width direction of the first housing, with at least each contact protrusion exposed from each of a pair of side faces of the recess.

Further, in another connector, the mating terminal housing part includes a connecting part that stretches in the width direction of the first housing, along with a pair of right and left contact arms that extend from the vicinity of both the right and left ends of the connecting part towards the mating face side, with the contact protrusion protruding from the vicinity of the tip of each contact arm towards the center in the width direction of the first housing.

Further, in still another connector, a portion of the connecting part is exposed from the bottom face of the recess into the recess, while a portion of each of a pair of right and left contact arms is exposed from each side face of the recess into the recess.

Further, in still another connector, a narrow constricted part is formed in a portion adjacent to the connecting part in each contact arm.

Further, in still another connector, the tail part extends from either one of the right or left end of the connecting part towards the outside in the width direction of the first housing, with adjacent first terminals installed so as to be opposite to each other in the width direction of the first housing.

Further, in still another connector, the first terminal is a member made of a tabular metal plate and is installed in the first housing such that the plate thickness direction of the metal plate coincides with the longitudinal direction of the first housing.

Further, in still another connector, the first housing includes a first mating guide part formed on both ends in the longitudinal direction, while the second housing includes a second mating guide part that is formed on both ends in the longitudinal direction and mates with the first mating guide part, a second reinforcing bracket is attached to the second mating guide part, the second reinforcing bracket includes an end plate part that covers at least a portion of the end face in the longitudinal direction of the second mating guide part, the lower portion of the end plate part is forked into a pair of right and left second reinforcing tail parts, and each of the second reinforcing tail parts is shaped to go around the lower end of the second mating guide part and stretch along the mounting face of the second housing.

Further, in still another connector, a recessed part is formed on both sides of each second reinforcing tail part in the mounting face of the second housing.

According to the present disclosure, the contact force of a pair of contact protrusions contained in a first terminal to a second terminal is strong, the extraction force for extracting the second terminal from the first terminal is also strong, the conduction state between the first terminal and the second terminal can be assuredly maintained, and the mating state between a first connector and a second connector can be stably maintained.

BRIEF DESCRIPTION OF THE DRAWINGS

FIGS. 3A-3B are surface views of the first connector according to the present embodiment, wherein FIG. 3A is a side view, FIG. 3B is a front view, and FIG. 3C is a bottom view.

FIGS. 5A-5C are cross-sectional views of the first connector according to the present embodiment, wherein FIG. 5A is the arrow cross-sectional view along line A-A of FIG. 4, FIG. 5B is the arrow cross-sectional view along line B-B of FIG. 4, and FIG. 5C is the arrow cross-sectional view along line C-C of FIG. 4.

FIGS. 7A-7C are surface views of the second connector according to the present embodiment, wherein FIG. 7A is a side view, FIG. 7B is a front view, and FIG. 7C is a bottom view.

FIGS. 9A and 9B are transverse cross-sectional views of the second connector according to the present embodiment, wherein FIG. 9A is the arrow cross-sectional view along line D-D of FIG. 8, and FIG. 9B is the arrow cross-sectional view along line E-E of FIG. 8.

DETAILED DESCRIPTION OF THE PREFERRED EMBODIMENTS

Embodiments will be described in detail below with reference to the drawings.

Figure 1:
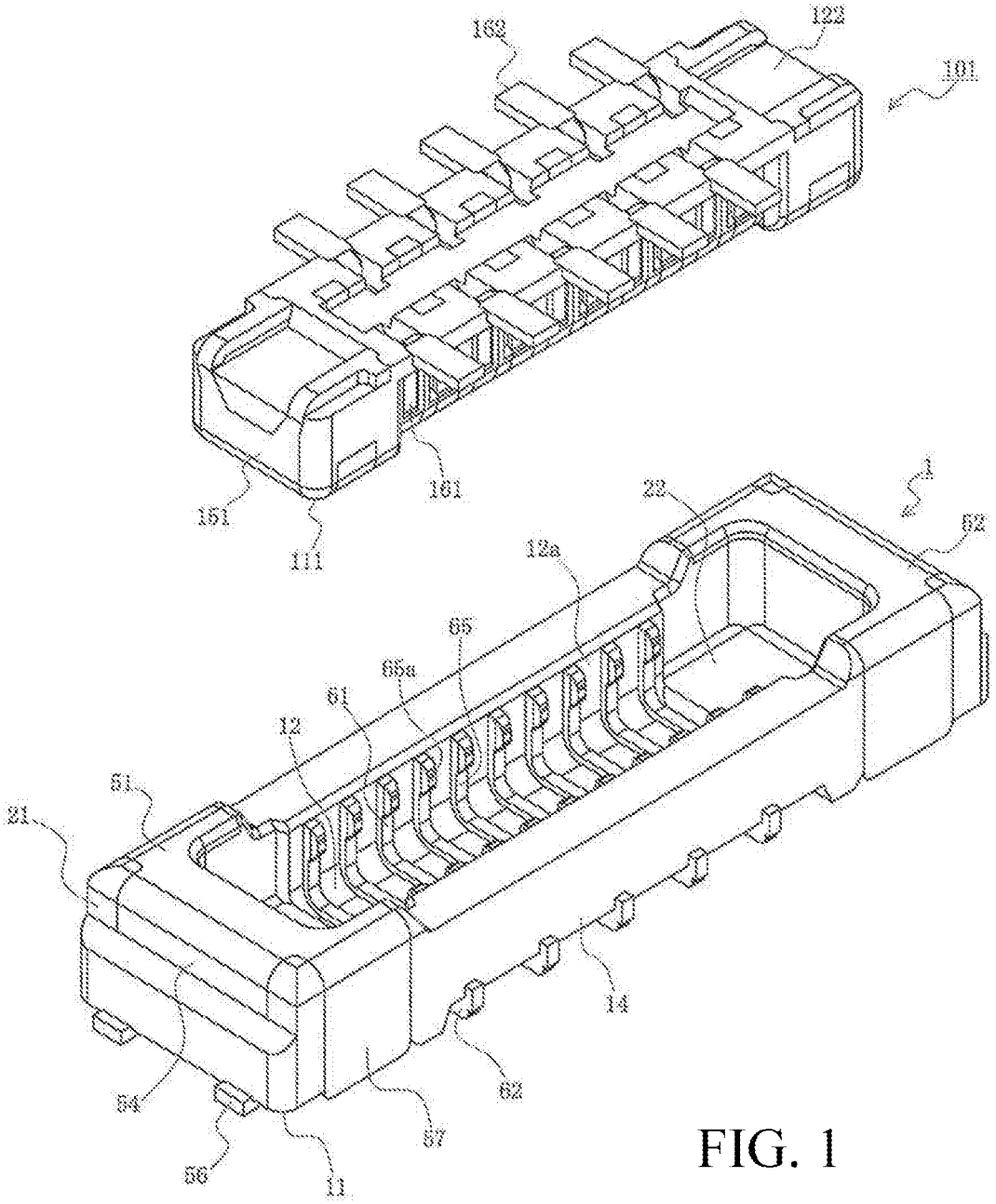
FIG. 1 is a perspective view of a first connector and a second connector according to the present embodiment.
Figure 2:
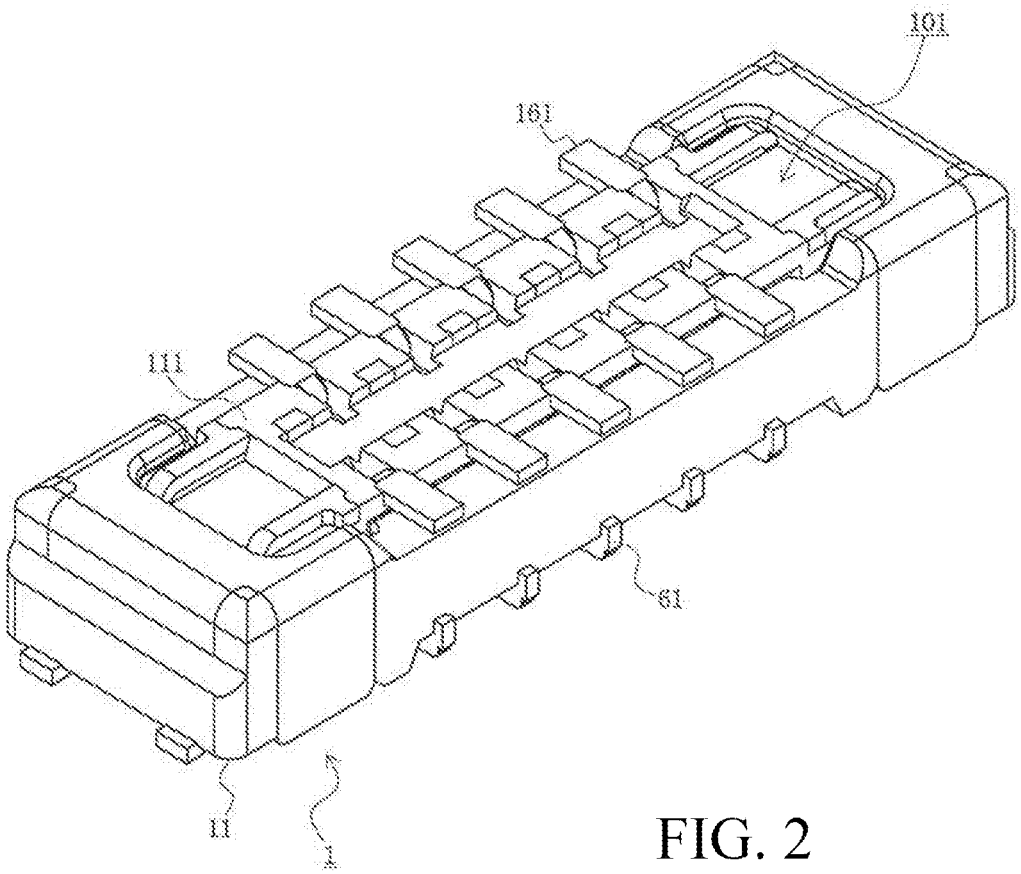
FIG. 2 is a perspective view illustrating a state in which the first connector and the second connector according to the present embodiment are mated together.
Figure 4:
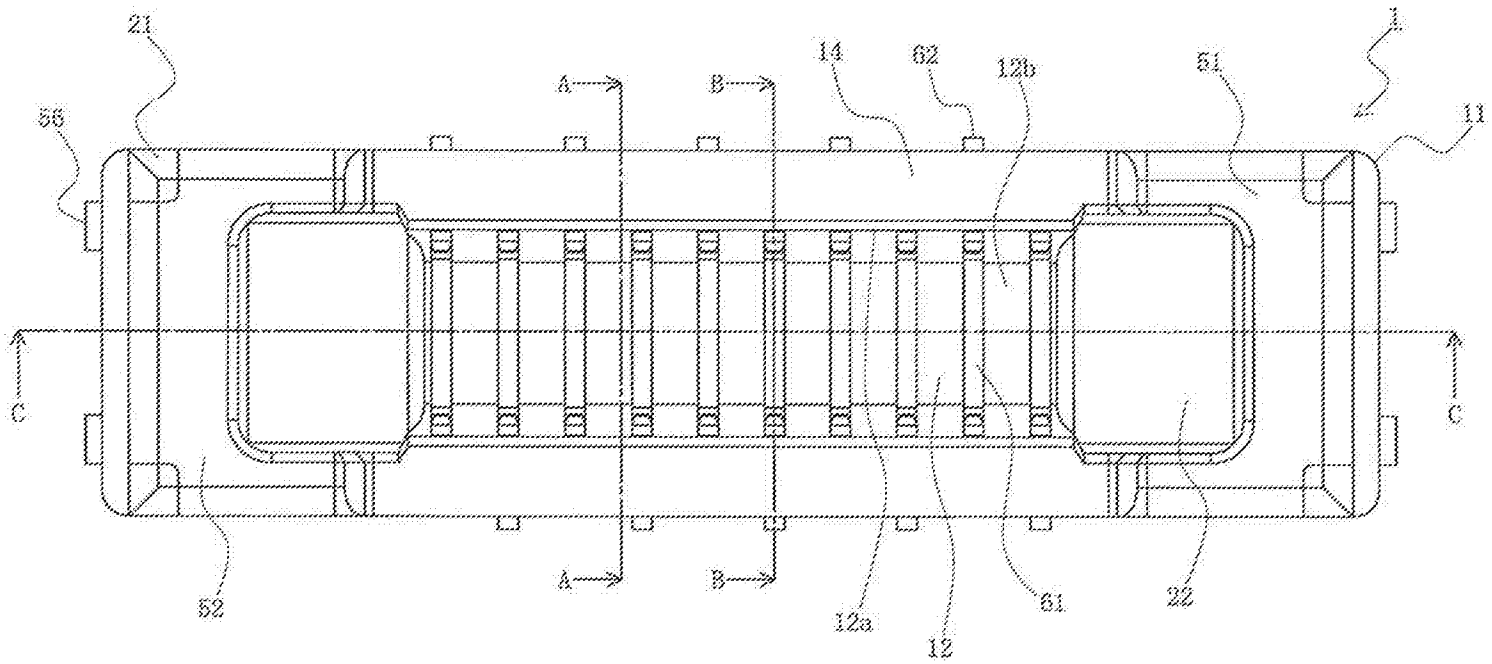
FIG. 4 is a plan view of the first connector according to the present embodiment.
Figure 5B:
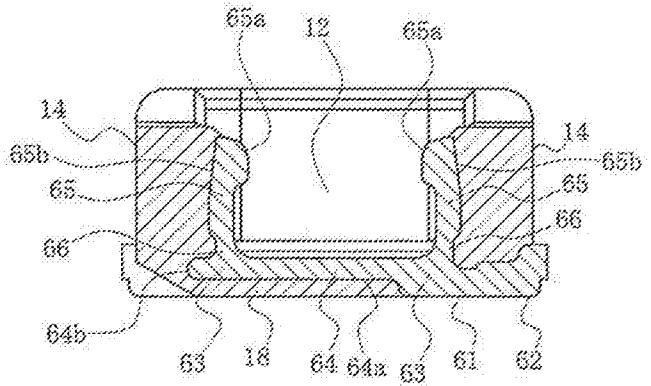
Figure 5A:
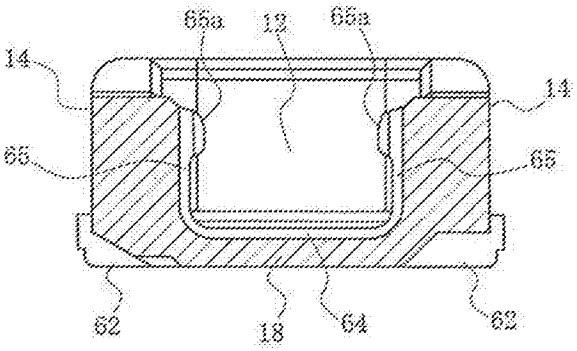
Figure 5C:
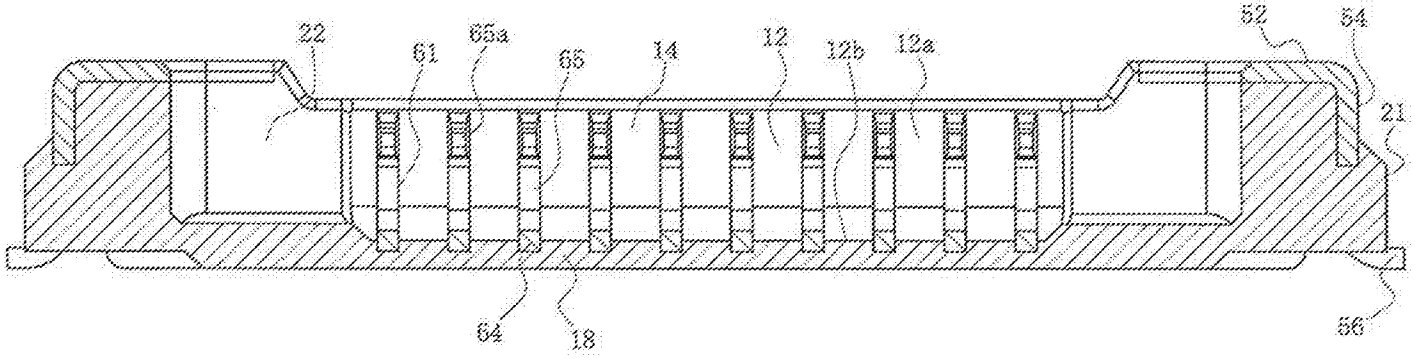

FIG. 1 is a perspective view of a first connector and a second connector according to the present embodiment, FIG. 2 is a perspective view illustrating a state in which the first connector and the second connector according to the present embodiment are mated together, FIGS. 3A-3C are three surface views of the first connector according to the present embodiment, FIG. 4 is a plan view of the first connector according to the present embodiment, and FIGS. 5A-5C are cross-sectional views of the first connector according to the present embodiment. Note that FIG. 3A is a side view, FIG. 3B is a front view, and FIG. 3C is a bottom view, while FIG. 5A is the arrow cross-sectional view along line A-A of FIG. 4, FIG. 5B is the arrow cross-sectional view along line B-B of FIG. 4, and FIG. 5C is the arrow cross-sectional view along line C-C of FIG. 4.

In the figure, 1 is a connector of the present embodiment and is the first connector serving as one of a pair of board to board connectors. First connector 1 is a surface mount type connector mounted on the surface of a first substrate not illustrated in the figure that serves as a mounting member, and is mated to second connector 101 that serves as a mating connector. Furthermore, second connector 101 is the second of the pair of board to board connectors and is a surface mount type connector mounted on the surface of a second substrate not illustrated in the figure that serves as a mounting member.

Note that while first connector 1 and second connector 101 are ideally used for electrically connecting the first substrate and the second substrate serving as substrates, the connectors can be used to electrically connect other members as well. Examples of the first substrate and second substrate include printed circuit boards, flexible flat cables (FFC), flexible printed circuit boards (FPC), etc. used in electronic equipment, etc., but may be any type of substrate.

Furthermore, expressions for indicating directions such as up, down, left, right, front, and back, used to describe the operations and configurations of the parts of first connector 1 and second connector 101 in the present embodiment are not absolute but rather relative directions, and though appropriate when the parts of first connector 1 and second connector 101 are in the positions illustrated in the figures, these directions should be interpreted differently when these positions change, to correspond to said change.

Furthermore, first connector 1 has first housing 11 as a connector body integrally formed of an insulating material such as a synthetic resin. As illustrated in the figure, first housing 11 is a substantially rectangular body having a substantially rectangular thick plate shape, wherein a substantially rectangular recess 12 surrounded by a periphery is formed on the side of the housing in which second connector 101 fits, that is, on the mating face side (upper side in FIG. 1). First connector 1 has, for example, dimensions of a length of approximately 4.0 [mm], a width of approximately 1.2 [mm], and a thickness of approximately 0.6 [mm], with said dimensions capable of being appropriately changed. Additionally, a pair of side walls 14 stretching in parallel to each other are integrally formed on both sides of recess 12 as first housing 11. Note that side wall 14 protrudes upward from bottom face 12*b* of recess 12 and stretches in the longitudinal direction of first housing 11. That is, the substantial shape of the transverse cross section of first housing 11 is a two thread shape in which one trough (recess 12) is sandwiched between two protruding threads (side walls 14). Moreover, bottom face 12*b* of recess 12 is the upper face of bottom plate part 18.

Here, multiple first terminals 61 as terminals are disposed in first housing 11 at a predetermined pitch. In the example illustrated in the figure, ten first terminals 61 are, for example, arranged at a pitch of approximately 0.2 [mm]. Note that the pitch and number of first terminals 61 can be appropriately changed. For example, the number of first terminals 61 can be odd rather than even. Moreover, mutually first terminals 61 are alternately arranged in the right and left direction.

First terminal 61 is a member integrally formed by carrying out processing such as punching on a tabular conductive metal plate that stretches in the width direction (right and left direction in FIG. 5B) and the height direction (vertical direction in FIG. 5B) of first housing 11. Additionally, first terminal 61 includes: connecting part 64 that stretches in the width direction of first housing 11; a pair of right and left contact arms 65 that extend from the vicinity of both the right and left ends of connecting part 64 towards the mating face side; and contact protrusion 65*a* protruding from the vicinity of the tip of each contact arm 65 towards the center in the width direction of first housing 11. Note that connecting part 64 and contact arm 65 including contact protrusion 65*a*, as illustrated in FIG. 5B, have a substantially U-shaped symmetric side cross-sectional shape, and function as a mating terminal housing part that houses second terminal 161 serving as a mating terminal and mates with second terminal 161. In this way, each first terminal 61 has a symmetric side cross-sectional shape of the mating terminal housing part, and the line connected to the center in the width direction of first housing 11 in the mating terminal housing part nearly coincides with the straight line stretching in the longitudinal direction of first housing 11. Accordingly, when seen from both ends in the longitudinal direction of first housing 11, nearly the entire mating terminal housing part of each first terminal 61 is overlapped.

Additionally, mutually facing right and left contact protrusions 65*a* contact second terminal 161. Moreover, tail part 62 extends towards the outside in the width direction of first housing 11 from the vicinity of one end of connecting part 64 on either one of the right or left (right in the example illustrated in FIG. 5B), that is, the mounting face side in coupling part 63 with contact arm 65, that is, the lower side. Further, constricted part 66 formed so as to be narrower than other portions is desirably formed in the vicinity of the base end of each contact arm 65, that is, the portion adjacent to coupling part 63.

First terminal 61 is integrated with first housing 11 by a molding method referred to as overmolding or insert molding. That is, first housing 11 is molded by filling the cavity of a mold, in which first terminal 61 has been set beforehand, with an insulating material. As a result, at least a portion of first terminal 61 is embedded in first housing 11 so as to be integrated with first housing 11. In greater detail, at least a portion of connecting part 64 is embedded in bottom plate part 18 so as to be integrated with bottom plate part 18, at least a portion of contact arm 65 is embedded in side wall 14 so as to be integrated with side wall 14, and at least a portion of coupling part 63 and at least a portion of tail part 62 are embedded in bottom plate part 18 and side wall 14 so as to be integrated with bottom plate part 18 and side wall 14.

In this case, when overall outer edge part 65*b* of contact arm 65 is embedded in side wall 14, the contact force of contact 65*a* can be stronger.

Moreover, when overall bottom edge part 64*a* of connecting part 64 is embedded in bottom plate part 18, the supporting strength of connecting part 64 increases, allowing unnecessary deformation to be prevented.

Note that in the example illustrated in the figure, the portion on the upper end side in connecting part 64, and the portion in the center on the width direction side of first housing 11 in right and left contact arms 65 are not embedded in bottom plate part 18 and side wall 14 but are exposed from bottom face 12*b* and side face 12*a* of recess 12 into recess 12, and portions in which connecting part 64 and right and left contact arms 65 are exposed into recess 12 are continuous; however, overall connecting part 64 may be embedded in bottom plate part 18, and overall portions excluding contact protrusions 65*a* of right and left contact arms 65 may be embedded in side wall 14. That is, regarding first terminal 61, if only contact protrusion 65*a* is exposed from side face 12*a* of recess 12 into recess 12, and a portion of tail part 62 is exposed outside first housing 11, all other portions may be embedded in first housing 11.

Tail part 62 extends towards the outside in the width direction of first housing 11, with the tip protruding outside the outer face of side wall 14. Moreover, the lower end of tail part 62 is nearly flush with lower face 13 (the mounting face) of bottom plate part 18, and connected, by soldering, etc., to the terminal connection pad coupled to the conductive trace on the first substrate. Note that as illustrated in FIGS. 3A and 3C, recessed part 13*a* that is recessed upward is formed at a position corresponding to each tail part 62 on lower face 13 of bottom plate part 18, and at least a portion of each tail part 62 is exposed into corresponding recessed part 13*a*. As illustrated in FIG. 3A, because this generates a space on both sides of each tail part 62, a fillet such as a solder fillet is formed on both sides of tail part 62. Accordingly, the connection of tail part 62 to the terminal connection pad is firm.

As described above, because mutually adjacent first terminals 61 are alternately arranged in the right and left direction, tail part 62, as illustrated in FIG. 3C, is arranged in an alternate (staggered) manner in the right and left direction (vertical direction in FIG. 3C) of first housing 11. Therefore, the interval, that is, the pitch, in the longitudinal direction of each of right and left first housings 11 of tail part 62 is twice the pitch of first terminal 61. As a result, even when the pitch between adjacent first terminals 61 is narrow, the pitch of tail part 62 on both the right and left sides of first connector 1, the pitch of the terminal connection pad formed on the mounting face of the first substrate so as to correspond to each tail part 62, etc. can be widened. Accordingly, the terminal connection pad, etc. can be easily manufactured and even upon soldering tail part 62 of first terminal 61 to the corresponding terminal connection pad, a solder bridge does not occur, preventing the generation of a short circuit between adjacent terminal connection pads, etc.

At the end part on the side opposite tail part 62 in connecting part 64 of first terminal 61, protruding end part 64*b* is formed in the extension portion thereof. Protruding end part 64*b* is formed outside constricted part 66. This protruding end part 64*b* prevents first terminal 61 from extraction from first housing 11 upon releasing the mating between first connector 1 and second connector 101.

Moreover, each first protruding end part 21 as a first mating guide part is disposed on both ends in the longitudinal direction of first housing 11. Mating recess 22 as a portion of recess 12 is formed on each first protruding end part 21. Mating recess 22 is a substantially rectangular recess located on both ends in the longitudinal direction of recess 12. Additionally, in the state in which first connector 1 and second connector 101 are mated, second protruding end part 122 contained in second connector 101 is inserted into mating recess 22.

First reinforcing bracket 51 as a reinforcing bracket is attached to first protruding end part 21. In the present embodiment, first reinforcing bracket 51 is a member formed by carrying out processing such as punching and bending on the metal plate, and includes: first body part 52 as a body part that covers at least a portion of the upper face of first protruding end part 21 as the mating side face of first housing 11; first side plate part 57 as a side plate part that is connected to first body part 52 and covers at least a portion of both the right and left side faces of first protruding end part 21; first end plate part 54 as an end plate part that is connected to first body part 52 and covers at least a portion of the end face in the longitudinal direction of first protruding end part 21; and a pair of first reinforcing tail parts 56 that are exposed to the lower face of first protruding end part 21. The lower end of first reinforcing tail part 56 is nearly flush with lower face 13 of bottom plate part 18, and connected, by soldering, etc., to the reinforcing bracket connection pad formed on the first substrate.

Additionally, first reinforcing bracket 51, like first terminal 61, is integrated with first housing 11 by a molding method referred to as overmolding or insert molding. As a result, at least a portion of first reinforcing bracket 51 is embedded in first housing 11 so as to be integrated with first protruding end part 21 of first housing 11. For example, as illustrated in FIG. 5C, the vicinity portion of the lower end of first end plate part 54 is embedded in first protruding end part 21. Moreover, a portion for connecting the lower end of first end plate part 54 with a pair of first reinforcing tail parts 56 is also embedded in first protruding end part 21.

Next, the configuration of second connector 101 will be described.

Figure 6:
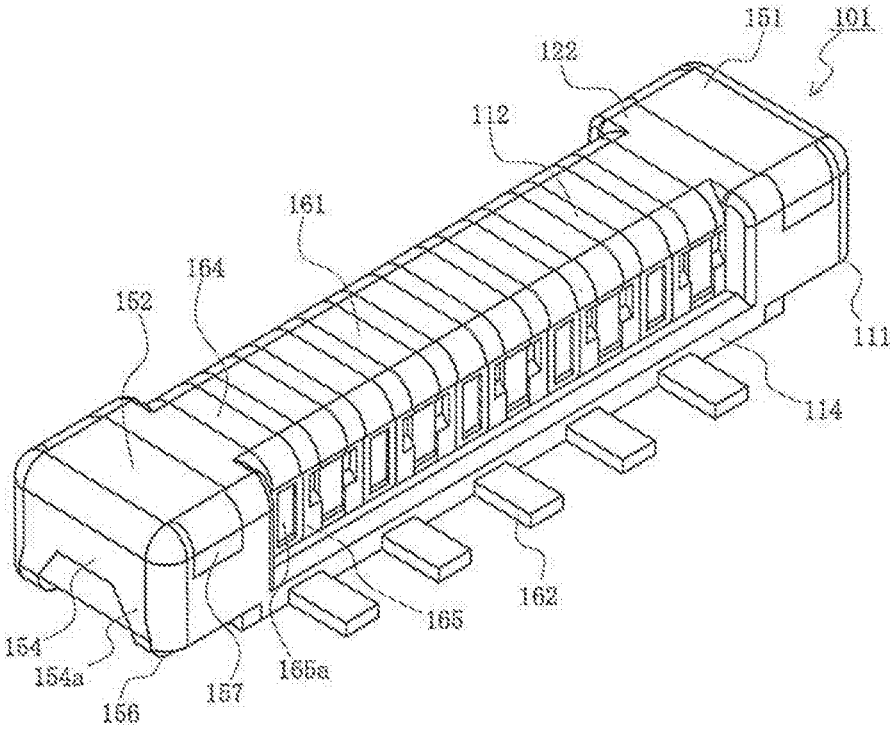
FIG. 6 is a perspective view of the second connector according to the present embodiment.
Figure 7B:
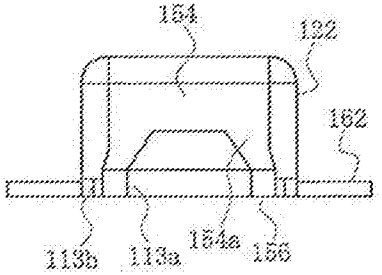
Figure 7A:
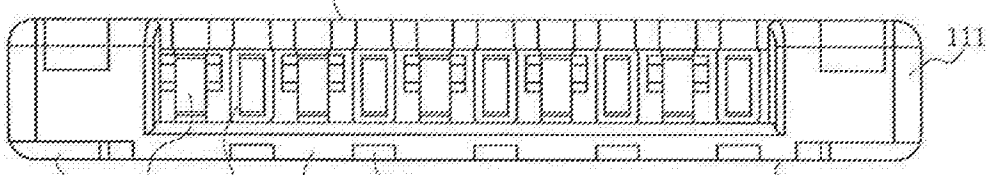
Figure 7C:
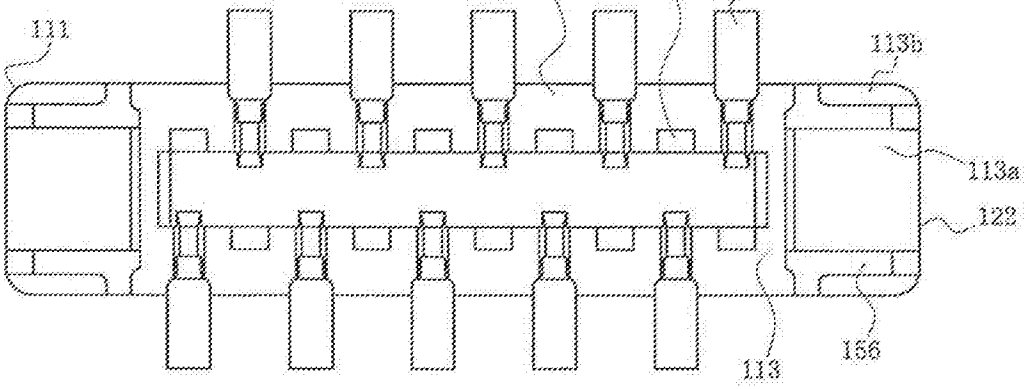
Figure 8:
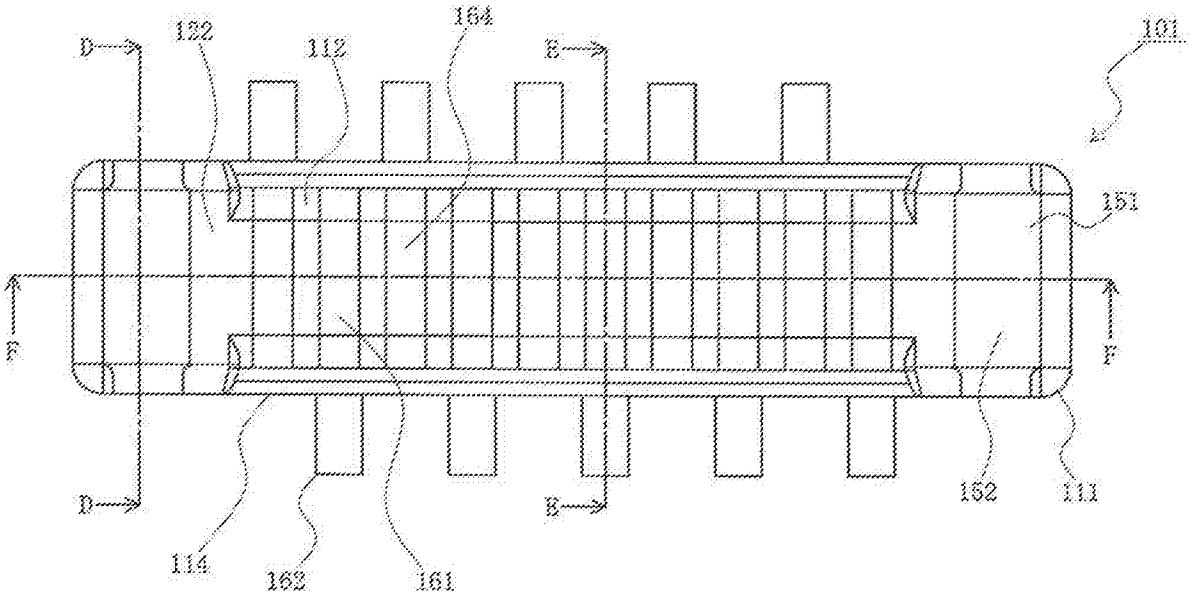
FIG. 8 is a plan view of the second connector according to the present embodiment.
Figure 9A:
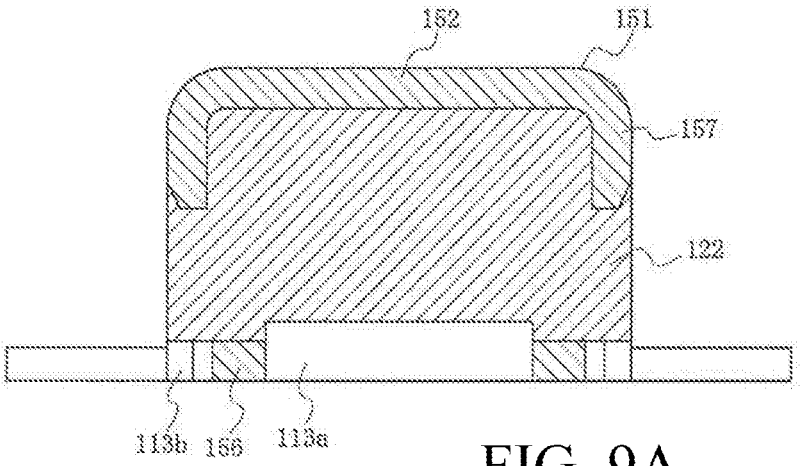
Figure 9B:
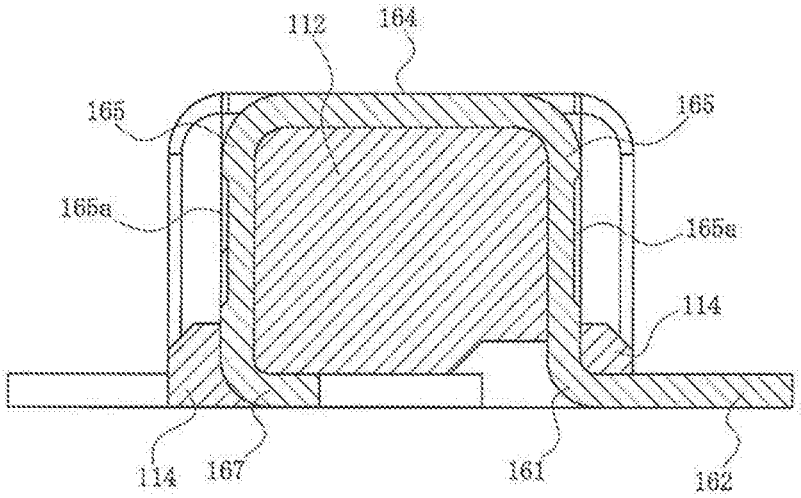
Figure 10:
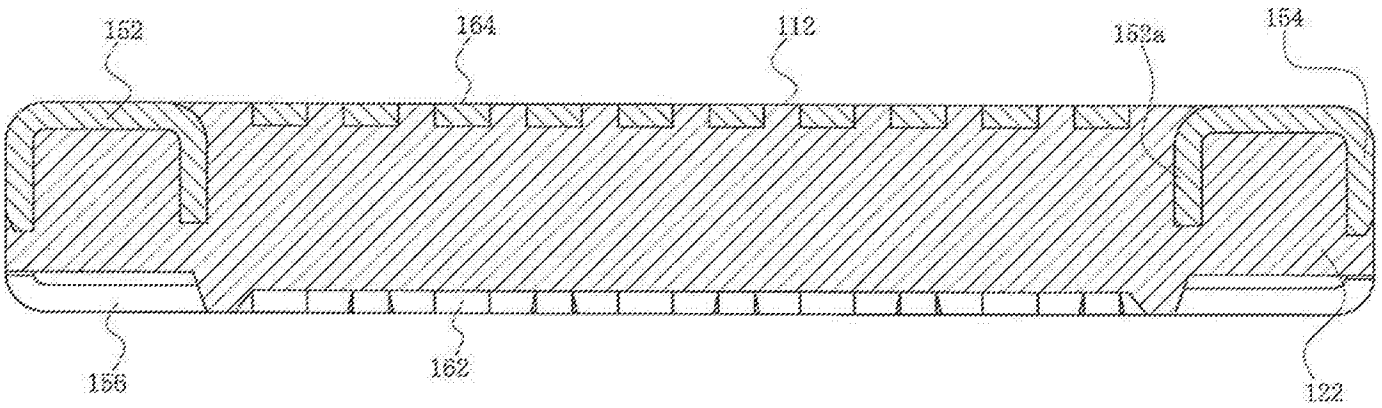
FIG. 10 is a longitudinal cross-sectional view of the second connector according to the present embodiment, in addition to being the arrow cross-sectional view along line F-F of FIG. 8.
Figure 11:
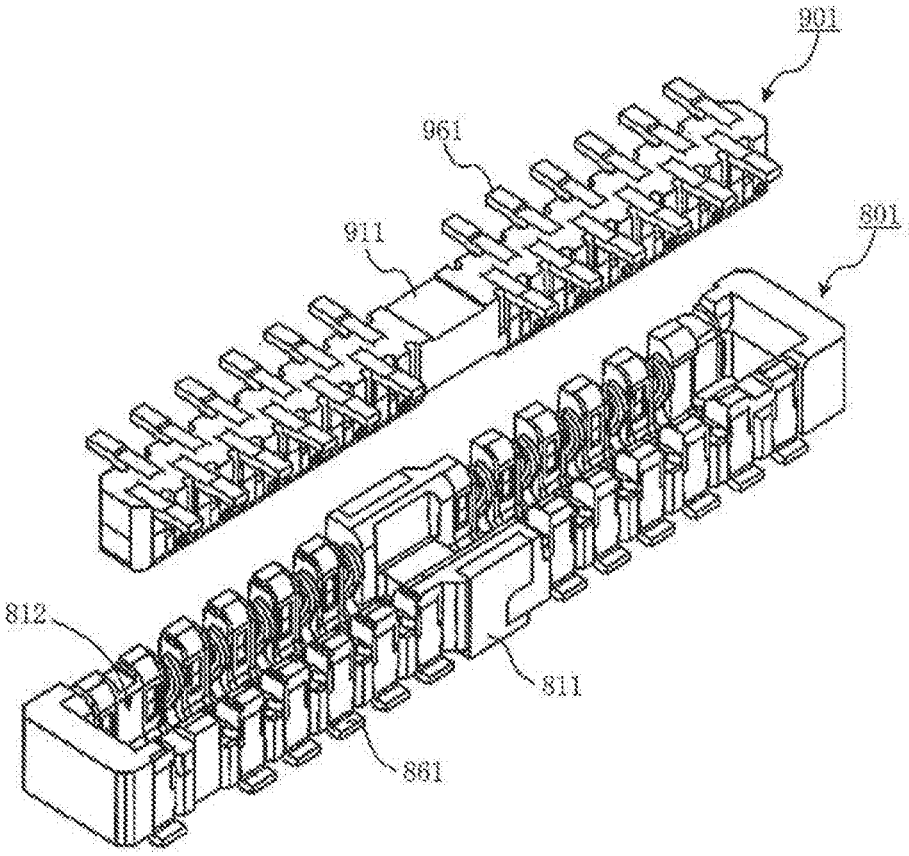
FIG. 11 is a perspective view illustrating a conventional connector.

FIG. 6 is a perspective view of the second connector according to the present embodiment, FIGS. 7A-7C are three surface views of the second connector according to the present embodiment, FIG. 8 is a plan view of the second connector according to the present embodiment, FIGS. 9A and 9B are transverse cross-sectional views of the second connector according to the present embodiment, and FIG. 10 is a longitudinal cross-sectional view of the second connector according to the present embodiment, in addition to being the arrow cross-sectional view along line F-F of FIG. 8. Note that FIG. 7A is a side view, FIG. 7B is a front view, and FIG. 7C is a bottom view, while FIG. 9A is the arrow cross-sectional view along line D-D of FIG. 8, and FIG. 9B is the arrow cross-sectional view along line E-E of FIG. 8.

Second connector 101 as a mating connector according to the present embodiment has second housing 111 as a mating connector body integrally formed of an insulating material such as a synthetic resin. Second housing 111, as illustrated in the figure, is a substantially rectangular body with the shape of a substantially rectangular thick plate, and has, for example, dimensions of a length of approximately 3.0 [mm], a width of approximately 0.6 [mm], and a thickness of approximately 0.5 [mm], with said dimensions capable of being appropriately changed. Additionally, second protrusion 112 serving as a long narrow protrusion stretching in the longitudinal direction of second housing 111 is formed on the side in which second housing 111 fits in first connector 1, that is, the mating face side (the upper side in FIG. 6). Second protrusion 112 is formed along the central axis in the longitudinal direction of second housing 111. That is, the substantial shape of the transverse cross section of second housing 111 is one thread shape made only of one protruding thread (second protrusion 112).

Note that second connector 101 is illustrated in the position in which the mating face is directed upward in FIG. 6, while in the state of being mated with first connector 1 and the state of having mated with first connector 1, that is, the state illustrated in FIGS. 1 and 2, the mating face is in the position facing the direction of the mounting face of first connector 1 and directed downward.

Flange part 114 extending outside in the width direction of second housing 111 is connected to both side faces of the lower end of second protrusion 112. Additionally, second terminal 161 as a mating terminal is disposed in second protrusion 112. Second terminal 161 is disposed at the pitch corresponding to first terminal 61 and in the number corresponding thereto. Moreover, mutually second terminals 161 are alternately arranged in the right and left direction.

Second terminal 161 is a member integrally formed by carrying out processing such as punching and bending on the conductive metal plate. Additionally, second terminal 161 includes: connecting part 164 that stretches in the width direction of second housing 111; a pair of right and left contact parts 165 that extend downward from both the right and left ends of connecting part 164; and contact recess 165*a* that is formed outside the contact part 165 so as to be recessed towards the center in the width direction of second housing 111. Note that connecting part 164 and contact part 165 including contact recess 165*a*, as illustrated in FIG. 9B, have a substantially U-shaped symmetric side cross-sectional shape, and function as a terminal entering part that enters the mating terminal housing part of first terminal 61 so as to be housed therein. In this way, each second terminal 161 has the symmetric side cross-sectional shape of the terminal entering part, and the line connected to the center in the width direction of second housing 111 in the terminal entering part nearly coincides with the straight line stretching in the longitudinal direction of second housing 111. Accordingly, when seen from both ends in the longitudinal direction of second housing 111, nearly the entire terminal entering part of each second terminal 161 is overlapped.

Additionally, right and left contact recesses 165*a* engage with contact protrusion 65*a* of first terminal 61. Note that the coupling portion between connecting part 164 and contact part 165 is formed to have a gently curved outer face shape, so as to be adapted to the outer face shape of second protrusion 112. Moreover, the base end of tail part 162 is curved and connected to the lower end of contact part 165 on either side of the right or left (right in the example illustrated in FIG. 9B). Tail part 162 extends from the base end towards the outside in the width direction of second housing 111. Further, the base end of fixed auxiliary part 167 is curved and connected to the lower end of contact part 165 on the other side (left in the example illustrated in FIG. 9B). Fixed auxiliary part 167 extends from the base end towards the same direction as tail part 162.

Second terminal 161, like first terminal 61, is integrated with second housing 111 by a molding method referred to as overmolding or insert molding. That is, second housing 111 is molded by filling the cavity of a mold, in which second terminal 161 has been set beforehand, with an insulating material. As a result, at least a portion of second terminal 161 is embedded in second housing 111 so as to be integrated with second housing 111. In greater detail, other portions excluding the upper face of connecting part 164 are embedded in second protrusion 112 so as to be integrated with second protrusion 112, other portions excluding the outer side face of contact part 165 are embedded in second protrusion 112 so as to be integrated with second protrusion 112, and the vicinity of the lower end of contact part 165, at least a portion of tail part 162, and at least a portion of fixed auxiliary part 167 are embedded in second protrusion 112 and flange part 114 so as to be integrated with second protrusion 112 and flange part 114.

Note that the outer face of the terminal entering part of second terminal 161 is nearly flush with the outer face of second protrusion 112. That is, the upper face of connecting part 164 is nearly flush with the upper face of second protrusion 112, the outer side face of contact part 165 is nearly flush with the side face of second protrusion 112, and the outer face of the coupling portion between connecting part 164 and contact part 165 is nearly flush with the outer face of the coupling portion between the upper face and the side face of second protrusion 112.

Tail part 162 extends toward the outside in the width direction of second housing 111, with the tip protruding outside the outer face of flange part 114. Moreover, the lower end of tail part 162 is nearly flush with the lower face of second protrusion 112, and connected, by soldering, etc., to the terminal connection pad coupled to the conductive trace on the first substrate.

As described above, because mutually adjacent second terminals 161 are alternately arranged in the right and left direction, tail part 162, as illustrated in FIG. 7C, is arranged in an alternate (staggered) manner in the right and left direction (vertical direction in FIG. 7C) of second housing 111. Therefore, the interval, that is, the pitch, in the longitudinal direction of each of right and left second housings 111 of tail part 162 is twice the pitch of second terminal 161. As a result, even when the pitch between adjacent second terminals 161 is narrow, the pitch of tail part 162 on both the right and left sides of second connector 101, the pitch of the terminal connection pad formed on the mounting face of the second substrate so as to correspond to each tail part 162, etc. can be widened. Accordingly, the terminal connection pad, etc. can be easily manufactured and even upon soldering tail part 162 of second terminal 161 to the corresponding terminal connection pad, a solder bridge does not occur, preventing the generation of a short circuit between adjacent terminal connection pads, etc.

Moreover, each second protruding end part 122 is disposed on both ends in the longitudinal direction of second housing 111 as a second mating guide part mating with first protruding end part 21. Each second protruding end part 122 is a member connected to both ends in the longitudinal direction of second protrusion 112, wherein the upper face thereof has a substantially rectangular shape. Additionally, in the state in which first connector 1 and second connector 101 are mated, second protruding end part 122 functions as an insertion protrusion inserted into mating recess 22 of first protruding end part 21 contained in first connector 1. Note that the width dimension of second protruding end part 122 is nearly the same as the width dimension of flange part 114.

Second reinforcing bracket 151 as a reinforcing bracket is attached to second protruding end part 122. In the present embodiment, second reinforcing bracket 151 is a member formed by carrying out processing such as punching and bending on the metal plate, and includes: second body part 152 as a body part that covers at least a portion of the upper face of second protruding end part 122 as the mating side face of second housing 111; second side plate part 157 as a side plate part connected to second body part 152 and covering at least a portion of both the right and left side faces of second protruding end part 122; second end plate part 154 as an end plate part that is connected to second body part 152 and covers at least a portion of the end face in the longitudinal direction of second protruding end part 122; a pair of second reinforcing tail parts 156 that are connected to second end plate part 154 and exposed to the lower face of second protruding end part 122; and embedded plate part 152*a* that is connected to second body part 152 and embedded in second protruding end part 122.

Note that the base end of each second reinforcing tail part 156 is bent and connected to the lower end of each of a pair of coupling legs 154*a* that extend downward from both ends of the lower end of second end plate part 154, while the tip of each second reinforcing tail part 156 stretches along lower face 113 as the mounting face of second housing 111 so as to face the center in the longitudinal direction of second housing 111. Accordingly, in second reinforcing bracket 151 seen from the front or back of second connector 101, the lower portion of second end plate part 154 is forked into second reinforcing tail part 156, and right and left second reinforcing tail parts 156 are shaped to go around the lower end of second protruding end part 122, and stretch along lower face 113 of second housing 111.

Additionally, the lower end of second reinforcing tail part 156 is nearly flush with lower face 113 of second housing 111, and connected, by soldering, etc., to the reinforcing bracket connection pad formed on the second substrate. Note that as illustrated in FIGS. 7A-7C and 9A, central recessed part 113*a* and side recessed part 113*b*, which are recessed upward, are formed at positions corresponding to both sides of second reinforcing tail part 156 on lower face 113. Note that when comprehensively described, central recessed part 113*a* and side recessed part 113*b* are described as recessed parts. Because this generates a space on both sides of each second reinforcing tail part 156, a fillet such as a solder fillet is formed on both sides of second reinforcing tail part 156. Accordingly, the connection of second reinforcing tail part 156 to the reinforcing bracket connection pad is firm.

Central recessed part 113*a* is deeper than side recessed part 113*b* and can house more excess solder and reduce the overflowing of excess solder.

Moreover, second reinforcing bracket 151, like second terminal 161, is integrated with second housing 111 by a molding method referred to as overmolding or insert molding. As a result, at least a portion of second reinforcing bracket 151 is embedded in second housing 111 so as to be integrated with second protruding end part 122 of second housing 111. For example, as illustrated in FIG. 10, overall embedded plate part 152*a* is embedded in second protruding end part 122.

The operation for mating first connector 1 and second connector 101 having the abovementioned configuration will be described next.

Here, first connector 1 is mounted on the surface of the first substrate by connecting tail 62 of first terminal 61 to a terminal connection pad coupled to a conductive trace of the first substrate (not illustrated) by soldering, etc., and connecting first reinforcing tail part 56 of first reinforcing bracket 51 to a reinforcing bracket connection pad by soldering, etc. Likewise, second connector 101 is mounted on the surface of the second substrate by connecting tail 162 of second terminal 161 to a connection pad coupled to a conductive trace of the second substrate (not illustrated) by soldering, etc., and connecting second reinforcing tail part 156 of second reinforcing bracket 151 to a reinforcing bracket connection pad by soldering, etc.

Additionally, an operator, as illustrated in FIG. 1, sets the state in which the mating face of first connector 1 is opposed to the mating face of second connector 101, positions first connector 1 and second connector 101, and moves first connector 1 and/or second connector 101 in the direction approaching the mating side, that is, in the mating direction.

As a result, second protrusion 112 in the center in the width direction of second connector 101 is inserted into recess 12 in the center in the width direction of first connector 1. Additionally, the terminal entering part of second terminal 161 of second connector 101 enters the mating terminal housing part of each first terminal 61 so as to be housed therein, while contact protrusion 65*a* of right and left contact arms 65 of first terminal 61 contacts the outer side face of right and left contact parts 165 of second terminal 161, and enters contact recess 165*a* so as to engage with contact recess 165*a*.

Because the interval between right and left contact protrusions 65*a* in the initial state is narrower than the interval between the outer side faces of right and left contact parts 165, when the terminal entering part of second terminal 161 enters the mating terminal housing part of first terminal 61, the interval between right and left contact protrusions 65*a* is pushed and widened so as to be expanded.

At this time, in the terminal entering part of second terminal 161, as illustrated in FIG. 9B, with an insulating material of second protrusion 112 filled between right and left contact parts 165 without any gaps, contact parts 165 are integrated with second protrusion 112. Consequently, the interval between the outer side faces of right and left contact parts 165 is not compressed.

In contrast, in the mating terminal housing part of first terminal 61, as illustrated in FIG. 5B, while right and left contact arms 65 are integrated with side wall 14 located outside contact protrusions 65*a*, the wall thickness of side wall 14 itself, as well as the wall thickness of bottom plate part 18 connected to the lower end of right and left side walls 14, is not too large. Consequently, if a strong force is imparted, the interval between right and left contact protrusions 65*a* is elastically expanded. In greater detail, when the vicinity of the lower end of contact arm 65 connected to connecting part 64 is elastically deformed, the vicinity of the connecting portion between the lower end of side wall 14 and bottom plate part 18 is also elastically deformed, and thereby the interval between right and left contact protrusions 65*a* is elastically expanded. Note that for the case in which constricted part 66 is formed, the elasticity in the vicinity of the lower end of contact arm 65 connected to connecting part 64 can be adjusted.

Additionally, first terminal 61 and second terminal 161 achieve a conduction state upon completion of the mating between first connector 1 and second connector 101, as illustrated in FIG. 2. In this state, by means of the function as a spring part exerted by the mating terminal housing part of first terminal 61 along with first housing 11 integrated with the mating terminal housing part, right and left contact protrusions 65*a* strongly hold right and left contact parts 165 of second terminal 161 from both sides thereof. As a result, because second terminal 161 is strongly held by first terminal 61, second terminal 161 is prevented from being separated from first terminal 61, and the mating between first connector 1 and second connector 101 is assuredly maintained. Further, because contact protrusion 65*a* engages with contact recess 165*a*, second terminal 161 is more assuredly prevented from being separated from first terminal 61, and the mating between first connector 1 and second connector 101 can be more assuredly maintained.

As a result, the conductive trace connected to the terminal connection pad on the first substrate to which tail part 62 of first terminal 61 is connected, and the conductive trace connected to the terminal connection pad on the second substrate to which tail part 162 of second terminal 161 is connected become conductive with one another.

Incidentally, because first connector 1 and second connector 101 are mounted on the first substrate and second substrate, respectively, which have wide areas, an operator cannot visually observe the mating face of first connector 1 and the mating face of second connector 101, so accordingly, the operator carries out the mating operation by trial and error. This trial and error makes precise positioning impossible, with the position of first connector 1 potentially shifted from the position of second connector 101. In this state, when an operator moves first connector 1 and/or second connector 101 in the mating direction, second protruding end part 122 of either one of second connectors 101 abuts first protruding end part 21 of either one of first connectors 1, first protruding end part 21 and/or second protruding end part 122 may receive a great pressing force in the mating direction, and be broken or damaged.

However, in the present embodiment, first reinforcing bracket 51 is attached to first protruding end part 21, at least a portion of the upper face as the mating side face of first protruding end part 21 is covered with first body part 52, second reinforcing bracket 151 is attached to second protruding end part 122, and at least a portion of the upper face as the mating side face of second protruding end part 122 is covered with second body part 152. Consequently, first protruding end part 21 and/or second protruding end part 122 are/is not broken or damaged.

In particular, in second reinforcing bracket 151 attached to second protruding end part 122 of second connector 101 having a small size, the lower portion of second end plate part 154 is forked into second reinforcing tail part 156, and right and left second reinforcing tail parts 156 are shaped to go around the lower end of second protruding end part 122 and stretch along lower face 113 of second housing 111, thereby increasing the strength. Accordingly, second protruding end part 122 is not broken or damaged.

In this way, in the present embodiment, the connector includes: first connector 1 having first terminal 61, along with first housing 11 with first terminal 61 installed therein; and second connector 101 mating with first connector 1 and having second terminal 161 in contact with first terminal 61, along with second housing 111 with second terminal 161 installed therein. Additionally, first housing 11 is grooved recess 12 that stretches in the longitudinal direction, with second protrusion 112 of second housing 111 inserted into recess 12, first terminal 61 includes a mating terminal housing part mated with second terminal 161, with at least a portion of the first terminal embedded in first housing 11 and integrated with first housing 11, and the mating terminal housing part includes a pair of contact protrusions 65*a* protruding towards the center in the width direction of first housing 11, with at least each contact protrusion 65*a* exposed from each of a pair of side faces 12*a* of recess 12.

As a result, because the mating terminal housing part of first terminal 61 is reinforced by first housing 11 so as to increase the rigidity, a pair of contact protrusions 65*a* can hold second terminal 161 by strong force, the contact force of a pair of contact protrusions 65*a* to second terminal 161 becomes strong, and the extraction force for extracting second terminal 161 from first terminal 61 also becomes strong. Accordingly, the conduction state between first terminal 61 and second terminal 161 can be assuredly maintained, while the mating state between connector 1 and second connector 101 can be stably maintained.

Moreover, the mating terminal housing part includes connecting part 64 that stretches in the width direction of first housing 11, along with a pair of right and left contact arms 65 that extend from the vicinity of both the right and left ends of connecting part 64 towards the mating face side, with contact protrusion 65*a* protruding from the vicinity of the tip of each contact arm 65 towards the center in the width direction of first housing 11. Accordingly, the mating terminal housing part can exert a spring force opposing a force for pushing and widening the interval between contact protrusions 65*a*, and thereby, a pair of contact protrusions 65*a* can hold second terminal 161 by a spring force.

Further, a portion of connecting part 64 is exposed from bottom face 12*b* of recess 12 into recess 12, while a portion of each of a pair of right and left contact arms 65 is exposed from each side face 12*a* of recess 12 into recess 12. In this way, portions of connecting part 64 and contact arm 65 are not embedded in first housing 11 but exposed, and thereby the degree of reinforcement by first housing 11 can be adjusted, while the contact force of a pair of contact protrusions 65*a* to second terminal 161, as well as the extraction force for extracting second terminal 161 from first terminal 61, can be adjusted.

Further, narrow constricted part 66 is formed in a portion adjacent to connecting part 64 in each contact arm 65. Accordingly, by adjusting the size, shape, etc. of constricted part 66, the rigidity of the mating terminal housing part can be adjusted and the contact force of a pair of contact protrusions 65*a* to second terminal 161, as well as the extraction force for extracting second terminal 161 from first terminal 61, can be adjusted.

Further, tail part 62 extends from either of the right or left end of connecting part 64 towards the outside in the width direction of first housing 11, with adjacent first terminals 61 installed so as to be opposite to each other in the width direction of first housing 11. As a result, even when the pitch of first terminal 61 is narrow, the pitch of tail part 62 can be widened, and upon soldering tail part 62 to the corresponding terminal connection pad, a solder bridge does not occur.

Further, first terminal 61 is a member made of a tabular metal plate and is installed in first housing 11 such that the plate thickness direction of the metal plate coincides with the longitudinal direction of first housing 11. Accordingly, the mating terminal housing part can exert a strong spring force relative to a force in the direction for pushing and widening the interval between contact protrusions 65*a*.

Further, first housing 11 includes first protruding end part 21 formed on both ends in the longitudinal direction, second housing 111 includes second protruding end part 122 that is formed on both ends in the longitudinal direction and mates with first protruding end part 21, second reinforcing bracket 151 is attached to second protruding end part 122, second reinforcing bracket 151 includes second end plate part 154 that covers at least a portion of the end face in the longitudinal direction of second protruding end part 122, the lower portion of second end plate part 154 is forked into a pair of right and left second reinforcing tail parts 156, and each of second reinforcing tail parts 156 is shaped to go around the lower end of second protruding end part 122 and stretch along lower face 113 of second housing 111. Accordingly, the strength of second reinforcing bracket 151 is improved, allowing second protruding end part 122 to be strongly protected.

Further, central recessed part 113*a* and side recessed part 113*b* are formed on both sides of each second reinforcing tail part 156 on lower face 113 of second housing 111. Accordingly, because a fillet such as a solder fillet is formed on both sides of second reinforcing tail part 156, the connection strength of second reinforcing tail part 156 is improved.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A plug connector configured to be mated with a receptacle connector, the plug connector comprising:

a housing having an elongated protrusion and a protrusion end part, the elongated protrusion extending in a longitudinal direction from the protrusion end part, the elongated protrusion having an upper side, the protrusion end part having an upper face and an end face;

a terminal which is at least partially embedded in the elongated protrusion; and a reinforcing metal member which is configured to be connected to the protrusion end part, the reinforcing metal member having a main body portion and an end plate portion, the main body portion covering at least a portion of the upper face of the protrusion end part, the main body portion being integrated with the housing by a molding method such that a plate portion thereof is embedded in the protrusion end part, the end plate portion covering at least a portion of the end face of the protrusion end part, wherein the protrusion end part has a lower face, and wherein the reinforcing metal member has a reinforcing tail portion, the reinforcing tail portion covering at least a portion of the lower face of the protrusion end part.

2. The plug connector as defined in claim 1, wherein the upper side of the elongated protrusion is convex is configuration.

3. The plug connector as defined in claim 1, wherein the reinforcing tail portion is connected to the end plate portion by a connecting leg portion of the end plate portion.

4. The plug connector as defined in claim 3, wherein the reinforcing tail portion is connected to a lower end of the end plate portion by a connecting leg portion of the end plate portion.

5. The plug connector as defined in claim 1, wherein the reinforcing tail portion extends toward the elongated protrusion in the longitudinal direction.

6. The plug connector as defined in claim 1, wherein the elongated protrusion has a lower face, and wherein the reinforcing tail portion is substantially flush with the lower face of the elongated protrusion.

7. The plug connector as defined in claim 6, wherein the lower face of the protrusion end part has a recessed part formed therein on opposite sides of the reinforcing tail portion.

8. A plug connector configured to be mated with a receptacle connector, the plug connector comprising:

a housing having an elongated protrusion and a protrusion end part, the elongated protrusion extending in a longitudinal direction from the protrusion end part, the elongated protrusion having an upper side, the protrusion end part having an upper face and an end face;

a terminal which is at least partially embedded in the elongated protrusion; and a reinforcing metal member which is configured to be connected to the protrusion end part, the reinforcing metal member having a main body portion and an end plate portion, the main body portion covering at least a portion of the upper face of the protrusion end part, the main body portion being integrated with the housing by a molding method such that a plate portion thereof is embedded in the protrusion end part, the end plate portion covering at least a portion of the end face of the protrusion end part, wherein the protrusion end part has a lower face, and wherein the reinforcing metal member has first and second reinforcing tail portions, each of the first and second reinforcing tail portions covering at least a portion of the lower face of the protrusion end part.

9. The plug connector as defined in claim 8, wherein the first reinforcing tail portion is connected to the end plate portion by a first connecting leg portion of the end plate portion, and wherein the second reinforcing tail portion is connected to the end plate portion by a second connecting leg portion of the end plate portion.

10. The plug connector as defined in claim 9, wherein the first reinforcing tail portion is connected to a lower end of the end plate portion by a first connecting leg portion of the end plate portion, and wherein the second reinforcing tail portion is connected to the lower end of the end plate portion by a second connecting leg portion of the end plate portion.

11. The plug connector as defined in claim 8, wherein each of the first and second reinforcing tail portions extend toward the elongated protrusion in the longitudinal direction.

12. The plug connector as defined in claim 8, wherein the elongated protrusion has a lower face, and wherein each of the first and second reinforcing tail portions is substantially flush with the lower face of the protrusion end part.

13. The plug connector as defined in claim 12, wherein the lower face of the protrusion end part has a central recessed part formed therein between inner sides of the first and second reinforcing tail portions.

14. The plug connector as defined in claim 13, wherein the lower face of the protrusion end part has a first side recessed part formed therein to an outer side of the first reinforcing tail portion, and wherein the lower face of the protrusion end part has a second side recessed part formed therein to an outer side of the second reinforcing tail portion.

15. The plug connector as defined in claim 12, wherein the lower face of the protrusion end part has a first side recessed part formed therein to an outer side of the first reinforcing tail portion, and wherein the lower face of the protrusion end part has a second side recessed part formed therein to an outer side of the second reinforcing tail portion.

16. A connector assembly, the connector assembly comprising:

a receptacle connector having a receptacle housing and a receptacle terminal, the receptacle terminal being held in the receptacle housing, the receptacle housing defining a recess; and a plug connector having a plug housing, a plug terminal, and a plug reinforcing metal member, the plug housing having an elongated protrusion and a protrusion end part, the elongated protrusion extending in a longitudinal direction from the protrusion end part, the elongated protrusion having an upper side, the protrusion end part having an upper face and an end face, the plug terminal being at least partially embedded in the elongated protrusion, the plug reinforcing metal member which is configured to be connected to the protrusion end part, the reinforcing metal member having a main body portion and an end plate portion, the main body portion covering at least a portion of the upper face of the protrusion end part, the main body portion being integrated with the housing by a molding method such that a plate portion thereof is embedded in the protrusion end part, the end plate portion covering at least a portion of the end face of the protrusion end part, wherein the plug connector is configured to mate with the receptacle connector by being at least partially inserted into the recess of the receptacle connector whereby the plug terminal contacts the receptacle terminal, and wherein the protrusion end part has a lower face, and wherein the reinforcing metal member has a reinforcing tail portion, the reinforcing tail portion covering at least a portion of the lower face of the protrusion end part.

17. The connector assembly as defined in claim 16, wherein the upper side of the elongated protrusion is convex is configuration.

18. A connector assembly, the connector assembly comprising:

a receptacle connector having a receptacle housing and a receptacle terminal, the receptacle terminal being held in the receptacle housing, the receptacle housing defining a recess; and a plug connector having a plug housing, a plug terminal, and a plug reinforcing metal member, the plug housing having an elongated protrusion and a protrusion end part, the elongated protrusion extending in a longitudinal direction from the protrusion end part, the elongated protrusion having an upper side, the protrusion end part having an upper face and an end face, the plug terminal being at least partially embedded in the elongated protrusion, the plug reinforcing metal member which is configured to be connected to the protrusion end part, the reinforcing metal member having a main body portion and an end plate portion, the main body portion covering at least a portion of the upper face of the protrusion end part, the main body portion being integrated with the housing by a molding method such that a plate portion thereof is embedded in the protrusion end part, the end plate portion covering at least a portion of the end face of the protrusion end part, wherein the plug connector is configured to mate with the receptacle connector by being at least partially inserted into the recess of the receptacle connector whereby the plug terminal contacts the receptacle terminal, and wherein the protrusion end part has a lower face, and wherein the reinforcing metal member has first and second reinforcing tail portions, each of the first and second reinforcing tail portions covering at least a portion of the lower face of the protrusion end part.

19. The connector assembly as defined in claim 18, wherein the first reinforcing tail portion is connected to the end plate portion by a first connecting leg portion of the end plate portion, and wherein the second reinforcing tail portion is connected to the end plate portion by a second connecting leg portion of the end plate portion.

20. The connector assembly as defined in claim 19, wherein the first reinforcing tail portion is connected to a lower end of the end plate portion by a first connecting leg portion of the end plate portion, and wherein the second reinforcing tail portion is connected to lower end of the end plate portion by a second connecting leg portion of the end plate portion.

21. The connector assembly as defined in claim 18, wherein each of the first and second reinforcing tail portions extend toward the elongated protrusion in the longitudinal direction.

22. The connector assembly as defined in claim 18, wherein the elongated protrusion has a lower face, and wherein each of the first and second reinforcing tail portions is substantially flush with the lower face of the protrusion end part.

23. The connector assembly as defined in claim 22, wherein the lower face of the protrusion end part has a central recessed part formed therein between inner sides of the first and second reinforcing tail portions.

24. The connector assembly as defined in claim 23, wherein the lower face of the protrusion end part has a first side recessed part formed therein to an outer side of the first reinforcing tail portion, and wherein the lower face of the protrusion end part has a second side recessed part formed therein to an outer side of the second reinforcing tail portion.

25. The connector assembly as defined in claim 22, wherein the lower face of the protrusion end part has a first side recessed part formed therein to an outer side of the first reinforcing tail portion, and wherein the lower face of the protrusion end part has a second side recessed part formed therein to an outer side of the second reinforcing tail portion.

* * * * *